US007131777B1

(12) United States Patent
Ryan, Jr. et al.

(10) Patent No.: US 7,131,777 B1
(45) Date of Patent: Nov. 7, 2006

(54) SYSTEM AND METHOD FOR IMPROVING PRINT QUALITY ON MAIL PIECES HAVING LOW REFLECTIVITY

(75) Inventors: Frederick W. Ryan, Jr., Oxford, CT (US); John F. Braun, Fairfield, CT (US); Ronald P. Sansone, Weston, CT (US); Robert A. Cordery, Danbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 12 days.

(21) Appl. No.: 11/127,566

(22) Filed: May 12, 2005

(51) Int. Cl.
*B41J 11/44* (2006.01)
*B41J 29/393* (2006.01)

(52) U.S. Cl. ..... 400/76; 347/19

(58) Field of Classification Search ..... 400/76; 347/19, 11, 17, 16, 14; 358/1.9; 250/226; 235/375
See application file for complete search history.

(56) References Cited

U.S. PATENT DOCUMENTS 5,157,253 A 10/1992 Strohmeyer et al. ..... 250/226
5,488,223 A 1/1996 Austin et al. ..... 235/375
6,398,117 B1 * 6/2002 Oakeson et al. ..... 235/494
6,435,642 B1 8/2002 Jackson et al. ..... 347/19
6,561,612 B1 5/2003 Minckler ..... 347/19
6,612,676 B1 9/2003 Minckler ..... 347/19
6,788,323 B1 * 9/2004 Enomoto et al. ..... 347/177
2006/0017758 A1 * 1/2006 Nambudiri et al. ..... 347/14

* cited by examiner

*Primary Examiner*—Judy Nguyen
*Assistant Examiner*—Wasseem H. Hamdan
(74) *Attorney, Agent, or Firm*—Brian A. Lemm; Angelo N. Chaclas

(57) ABSTRACT

A printing system is provided that dynamically adjusts the method of printing an image based on the lightness or darkness of the medium upon which the image will be printed. The reflectivity of the medium upon which an image is to be printed is determined, and the way in which the image will be printed is adjusted based on the determined reflectivity of the medium. For lighter colored mediums, on which sufficient contrast will be provided, the image can be printed directly onto the medium. For darker colored mediums, on which the ink used to print the image will not provide enough contrast with respect to the medium to produce a reliably readable image, the method of printing the image is modified to ensure that sufficient contrast is always provided to produce a reliably readable image.

9 Claims, 5 Drawing Sheets

SYSTEM AND METHOD FOR IMPROVING PRINT QUALITY ON MAIL PIECES HAVING LOW REFLECTIVITY

FIELD OF THE INVENTION

The invention disclosed herein relates generally to printing systems, and more particularly to systems and methods for improving print quality on mail pieces.

BACKGROUND OF THE INVENTION

Mail processing systems for printing postage indicia on envelopes and other forms of mail pieces have long been well known and have enjoyed considerable commercial success. There are many different types of mail processing systems, ranging from relatively small units that handle only one mail piece at a time, to large, multi-functional units that can process thousands of mail pieces per hour in a continuous stream operation. The larger mailing machines often include different modules that automate the processes of producing mail pieces, each of which performs a different task on the mail piece. The mail piece is conveyed downstream utilizing a transport mechanism, such as rollers or a belt, to each of the modules. Such modules could include, for example, a singulating module, i.e., separating a stack of mail pieces such that the mail pieces are conveyed one at a time along the transport path, a moistening/sealing module, i.e., wetting and closing the glued flap of an envelope, a weighing module, and a metering module, i.e., applying evidence of postage to the mail piece. The exact configuration of the mailing machine is, of course, particular to the needs of the user.

Typically, a control device, such as, for example, a microprocessor, performs user interface and controller functions for the mailing machine. Specifically, the control device provides all user interfaces, executes control of the mailing machine and print operations, calculates postage for debit based upon rate tables, provides the conduit for the Postal Security Device (PSD) to transfer postage indicia to the printer, operates with peripherals for accounting, printing and weighing, and conducts communications with a data center for postage funds refill, software download, rates download, and market-oriented data capture. The control device, in conjunction with an embedded PSD, constitutes the system meter that satisfies U.S. information-based indicia postage meter requirements and other international postal regulations regarding closed system meters. The United States Postal Service (USPS) initiated the Information-Based Indicia Program (IBIP) to enhance the security of postage metering by supporting new methods of applying postage to mail. The USPS has published draft specifications for the IBIP. The requirements for a closed system are defined in the "Performance Criteria for Information-Based Indicia and Security Architecture for Closed IBI Postage Metering System (PCIBI-C), dated Jan. 12, 1999. A closed system is a system whose basic components are dedicated to the production of information-based indicia and related functions, similar to an existing, traditional postage meter. A closed system, which may be a proprietary device used alone or in conjunction with other closely related, specialized equipment, includes the indicia print mechanism.

The PCIBI-C specification defines the requirements for the indicium to be applied to mail produced by closed systems. An example of such an indicium is illustrated in FIG. 1. The indicium 10 consists of a two-dimensional (2D) barcode 12 and certain human-readable information 14.

Some of the data included in the barcode can include, for example, the PSD manufacturer identification, PSD model identification, PSD serial number, values for the ascending and descending registers of the PSD, postage amount, and date of mailing. In addition, a digital signature is required to be created by the PSD for each mail piece and placed in the digital signature field of the barcode. Verification of indicium is performed by the postal service scanning a mail piece to read the 2D barcode and verifying the information contained therein, including the digital signature. If the verification is unsuccessful, indicating that the indicium may not be authentic, the mail piece may not be delivered.

Since postal services accept indicia printed by mail processing systems as conclusive proof of payment of the amount of postage indicated, such devices are in effect machines for printing money. As a result postal services have imposed high standards for the print quality of indicia images produced by such machines, to ensure that the postal verification equipment can properly read and decode the barcodes included in the indicium. Many postal services, such as, for example, the United States Postal Service (USPS), specify acceptable contrast ratios that must be provided between images printed on a mail piece and the mail piece for the images to be properly read. Even if an indicium is valid, if the verification equipment is unable to read the indicium due to poor contrast ratio or print quality, verification will not be possible. It is therefore necessary to ensure that the printing systems utilized by the mail processing systems are capable of consistently producing high quality images that have sufficient contrast with the background to increase the read rates of such images.

In recent years, ink jet printing systems have been utilized in mail processing systems. Ink jet printing systems, as used herein, includes any form of printing wherein print control signals control a print mechanism to eject ink drops to produce a matrix of pixels, i.e. picture elements, to represent an image. An ink supply, typically in the form of a reservoir, supplies ink to the print mechanism. In highly-controlled environments, e.g., on a single substrate matched to the printing method, it is possible to consistently achieve high quality prints that will achieve high barcode read rates. Mail processing systems, however, are not controlled environments, as printing will be performed on a variety of substrates, e.g., mail pieces, having different characteristics. Currently, the ink used in mail processing systems is manufactured to be as dark as possible to provide the greatest contrast with respect to a typical mail piece upon which an indicium will be printed, such as, for example, a white or off-white mail piece. For darker colored mail pieces or glossy mail pieces, however, the contrast between the ink used for printing and the background may be insufficient for the indicium to be properly read.

Thus, there exists a need for systems and methods for improving print quality on mail pieces that do not have sufficient contrast with the ink used to print an image to increase the read rates of images printed on such mail pieces.

SUMMARY OF THE INVENTION

The present invention alleviates the problems associated with the prior art and provides systems and methods for improving print quality on darker colored mail pieces having low reflectivity to increase the read rates of images printed on such mail pieces.

In accordance with embodiments of the present invention, a printing system is provided that dynamically adjusts the method of printing an image based on the lightness or darkness of the medium upon which the image will be printed. The reflectivity of the medium upon which an image is to be printed is determined, and hence the relative lightness or darkness of the medium. The way in which the image will be printed is adjusted based on the determined reflectivity of the medium. For lighter colored mediums, on which sufficient contrast between the ink used to print the image and the medium will be provided, the image can be printed directly onto the medium. For darker colored media or glossy media, on which the ink used to print the image will not provide enough contrast with respect to the medium to produce a reliably readable image, the method of printing the image is modified. In one embodiment, the image is printed on a label which is automatically applied to the medium. In another embodiment, the image is printed on a label that the user can apply to the medium. In another embodiment, the image is printed with a different color ink, such as, for example, an inverse image, or with multiple inks, such as, for example, a background ink and a foreground ink. Since the method of printing the image is adjusted for each different medium, it ensures that sufficient contrast is always provided between the image and the background to produce a reliably readable image.

Therefore, it should now be apparent that the invention substantially achieves all the above aspects and advantages. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

DESCRIPTION OF THE DRAWINGS

The accompanying drawings illustrate a presently preferred embodiment of the invention, and together with the general description given above and the detailed description given below, serve to explain the principles of the invention. As shown throughout the drawings, like reference numerals designate like or corresponding parts.

DETAILED DESCRIPTION OF THE PRESENT INVENTION

Figure 1:
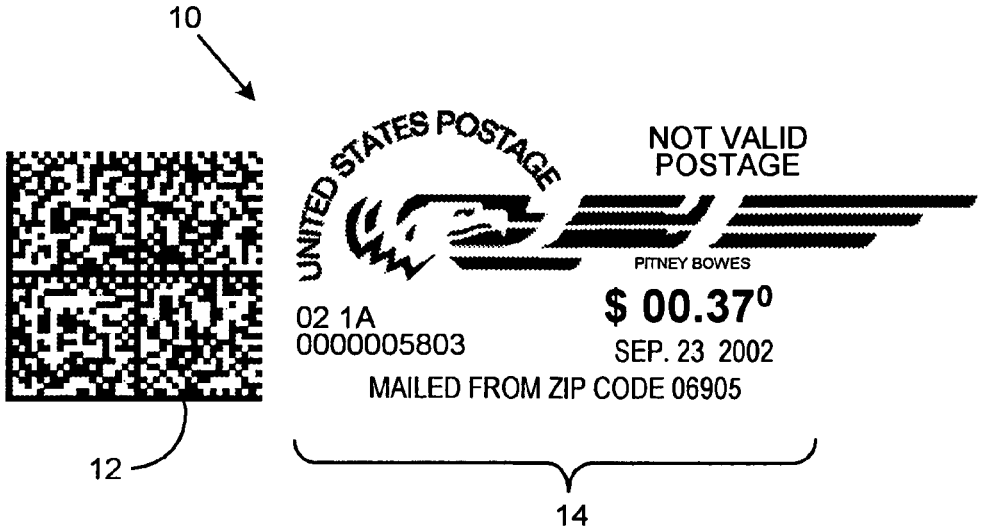
FIG. 1 ( PRIOR ART )
FIG. 1 illustrates an example of an indicium that meets the IBIP specifications.
Figure 2:
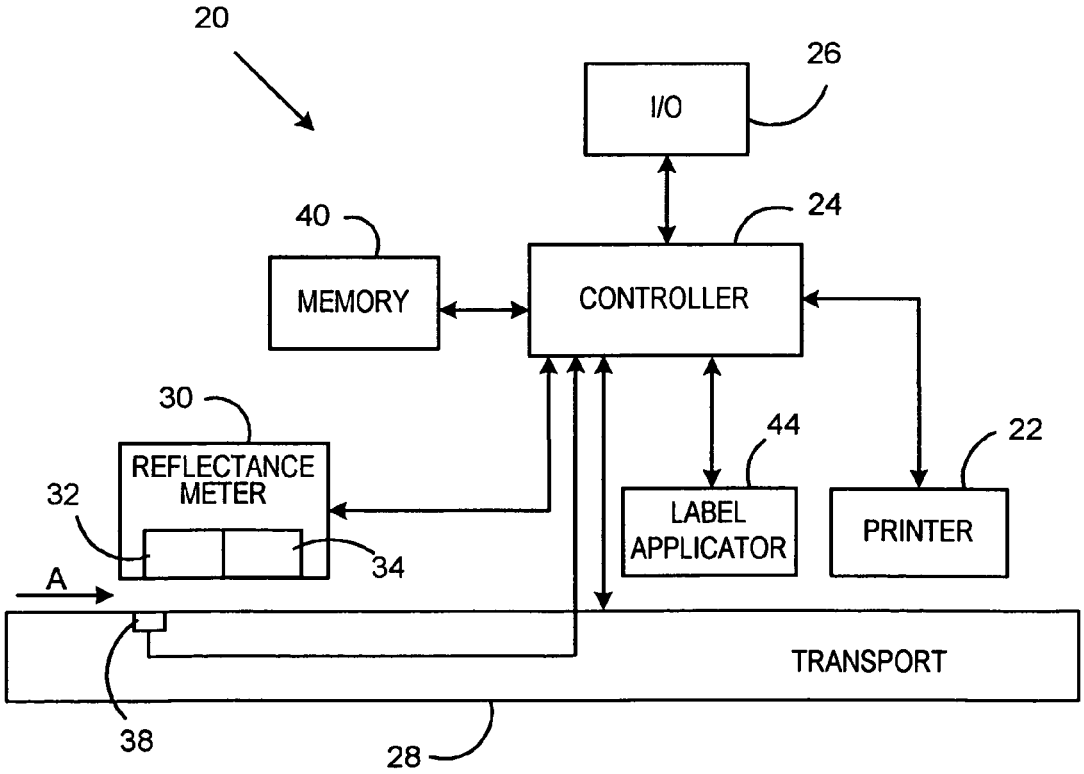
FIG. 2 illustrates in block diagram form a portion of a mail processing system according to an embodiment of the present invention.

In describing the present invention, reference is made to the drawings, wherein there is seen in FIG. 2 a portion of a mail processing system 20 according to an embodiment of the present invention. It should be noted that while the following description is being made with respect to a mail processing system, the present invention is not so limited and can be utilized in any type of printing system that must print images to meet specified contrast requirements. Mail processing system 20 includes a controller 24, that preferably includes one or more controller units, such as, for example, a microprocessor, general or special purpose processor or the like, to control operation of the mail processing system 20. A memory 40 is coupled to the controller 24 for storage of data. Controller 24 is coupled to one or more input/output devices 26, such as, for example, a keyboard and/or display unit for the input and output of various data and information. A printer 22, preferably an ink jet printer adapted to print postage indicia generated by the controller 24 on mail pieces, is coupled to controller 24. A transport 28, including, for example, rollers and/or belts, can be utilized to transport mail pieces through the mail processing system 20 in the direction indicated by arrow A based on signals provided from the controller 24. The transport 28 will transport the mail pieces past the printer 22 such that printing can occur on each mail piece. Sensors, such as, for example, sensor 38, located along the transport 28 provide signals to the controller 24 to indicate the position of a mail piece on the transport 28. It should be noted that while only one sensor 38 is shown, a plurality of such sensors may be provided along the transport 28. Alternatively, transport 28 need not be provided and instead the printer 22 can move to print an image on a stationary mail piece.

According to embodiments of the present invention, mail processing system 20 can dynamically adjust the method with which each indicium is printed to ensure sufficient contrast with the medium upon which each indicium is printed, thereby producing reliably readable indicia. Mail processing system 20 includes a label applicator 44 located along the transport 28, preferably upstream from the printer 22. If no transport 28 is provided, the label applicator 44 can be integral with or coupled to the printer 22 to move along with the printer 22. The label applicator 44 is coupled to the controller 24, and when instructed by the controller 24 as described below, will apply a label directly onto a mail piece as the mail piece is transported by the transport 28 past the label applicator 44 or as the printer 22 moves over the mail piece. Mail processing system 20 further includes a reflectance meter 30, preferably located upstream of the label applicator 44. Reflectance meter 30 includes one or more light sources 32 and one or more photodetectors 34. Reflectance meter 30 could be, for example, a spectrophotometer. As a mail piece is being transported by transport 28 past the reflectance meter 30, or if transport 28 is not provided, when the mail piece is placed into the system 20 by an operator, light is applied to the mail piece by the light source 32. The light reflected from the mail piece is received by the photodetectors 34. Optionally, reflectance meter 30 can be provided with a shield or baffles (not shown) to reduce the amount of environmental light, e.g., light from outside sources other than light reflected from the mail piece, received by the photodetectors 34, which could cause an improper reading of the actual reflected light. Based on the amount of reflected light received by the photodetectors 34, the relative darkness, lightness or glossiness of the mail piece can be determined. The amount of reflected light is less for a darker mail piece than a lighter mail piece, as the darker mail piece will absorb part of the applied light from the light source 32, while a lighter mail piece will have less absorption of the applied light and therefore more reflected light. For glossy surfaces, the amount of light reflected is redistributed such that the contrast ratio between an image printed on the surface and the glossy surface could be negatively affected to the point that is unreadable.

The reflected light signals received by the photodetectors 34 are processed by the reflectance meter 30 to determine the lightness or darkness, or glossiness, of the mail piece. Such processing could include, for example, amplification of the signals by conventional amplifiers to provide a range of voltages that correspond to the amount of reflectance between 0 and 100%. The reflectance, as determined by the reflectance meter 30, is provided to the controller 24. Alternatively, processing of the reflected light signals could be done by the controller 24. In either case, once the controller 24 has either received or determined the reflectance of the mail piece, the controller 24 can determine the relative lightness or darkness or glossiness of the mail piece and, based on the lightness or darkness or glossiness of the mail piece, determine if the contrast between the ink used to print the indicium and the mail piece will be sufficient to ensure a reliably readable indicium. Determination of sufficient contrast could be performed, for example, utilizing a threshold number for the reflectivity. Thus, for example, if the reflectivity is less than 50%, indicating that more than half of the applied light was absorbed by the mail piece, the controller 24 can determine that the mail piece is a darker medium such that the contrast between the ink used to print the indicium and the mail piece will be insufficient to ensure a reliably readable indicium. Conversely, if the reflectivity is greater than or equal to 50%, indicating that most of the light was reflected by the mail piece, the controller 24 can determine that the mail piece is a lighter medium, and the contrast between the ink used to print the indicium and the mail piece will be sufficient to ensure a reliably readable indicium. Alternatively, the reflectivity could be determined, for example, by controller 24 utilizing a look-up table stored in memory 40. Reflectivity could also be determined based on comparison with a reference medium, especially in the case when large batches of the same type of mail piece will be processed. In this scenario, before a large batch of mail is processed, a reference medium, such as, for example, a standard white envelope, could be processed through the system 20 (preferably without actually printing an indicium thereon or just a test indicium that has no value) and the reflectivity of the reference medium set as a benchmark. A mail piece from the batch can then be processed by the system 20, and the reflectivity of the mail piece compared to the benchmark (or some associated range around the benchmark) established by the reference medium. If the reflectivity of the mail piece is within the associated range, the controller 24 can determine that the mail pieces of the batch are light and that the contrast between the ink used to print the indicium and the mail piece will be sufficient to ensure a reliably readable indicium.

The controller 24 will modify the way in which the indicium is printed on the mail piece based on the determined reflectivity of the mail piece. If it is determined that the contrast between the ink used to print the indicium and the mail piece will be sufficient to ensure a reliably readable indicium, the indicium will be printed directly on the mail piece by the printer 22. If however, it is determined that the contrast between the ink used to print the indicium and the mail piece will be insufficient to ensure a reliably readable indicium, then the controller 24 will instruct the label applicator 44 to apply a label to the mail piece. The labels applied by the label applicator 44 preferably have a very high reflectivity, and therefore any images printed on the label by the printer 22 will have sufficient contrast between the ink and the label to ensure a reliably readable image. The labels applied by the label applicator 44 can be any size, but are preferably of a fixed length just large enough to contain the complete indicium image or only the barcode portion of the indicium image. The labels are applied to the mail piece in the proper location on the mail piece, e.g., in the upper right hand corner for an indicium image. After having the label applied, the mail piece will be transported by the transport 28 to the printer 22, wherein the indicium image (or barcode portion thereof) will be printed on the label previously applied. If the transport 28 is not provided, the label will be applied by the label applicator 44 as it moves with the printer 22, and the printer 22 will print the indicium image on the label. By automatically applying a high reflectivity label to darker colored or glossy mediums, e.g., envelopes or mail pieces, and printing on the label, it ensures that sufficient contrast is always provided between the image, e.g., indicium, and the background to produce a reliably readable image. Alternatively, the printer 22 can print the indicium on the label before applying the label to the mail piece, and the printed label can be applied to the mail piece.

Figure 3:
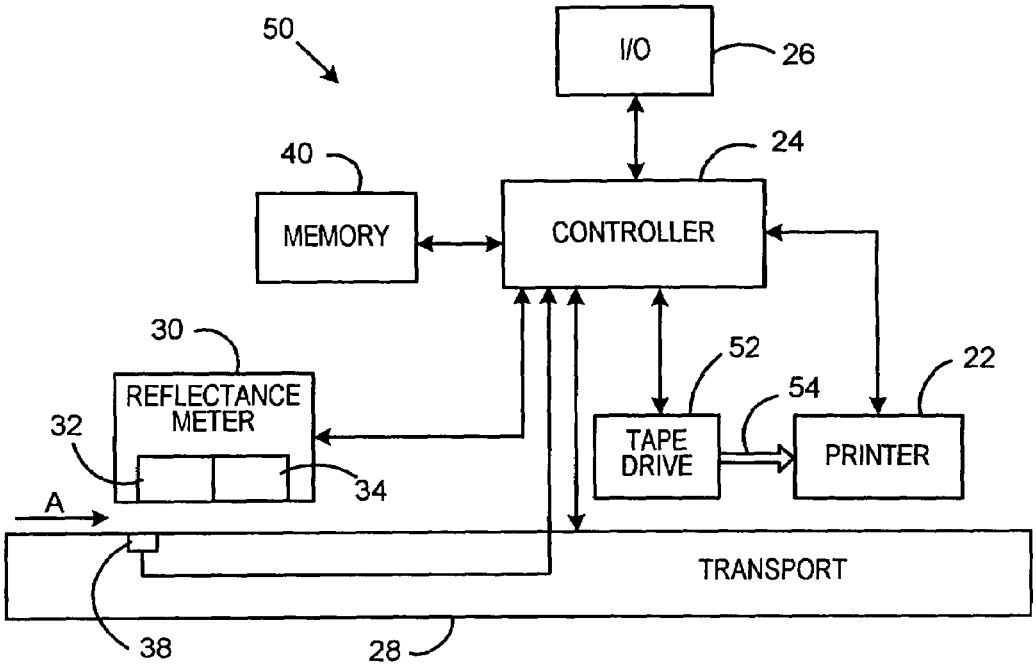
FIG. 3 illustrates in block diagram form a portion of a mail processing system according to another embodiment of the present invention.

Referring now to FIG. 3, there is illustrated in block diagram form a portion of a mail processing system 50 according to another embodiment of the present invention. Mail processing system 50 is similar to mail processing system 20 as described with respect to FIG. 2, except that the mail processing system 50 does not include the label applicator 44 and instead preferably includes a tape drive 52. Tape drive 52 can provide a tape or other type of adhesive label (hereinafter collectively referred to as tape) to printer 22 along processing path 54, based on instructions from the controller 24. The tape can be cut from a continuous reel to allow proper sizing of the tape. A postage indicium can be printed on the tape instead of printing the postage indicium on the mail piece. The tape can then be affixed to mail piece either automatically or manually.

The controller 24 will modify the way in which the indicium is printed on the mail piece based on the determined reflectivity of the mail piece. If it is determined that the contrast between the ink used to print the indicium and the mail piece will be sufficient to ensure a reliably readable indicium, the indicium will be printed directly on the mail piece by the printer 22. If however, it is determined that the contrast between the ink used to print the indicium and the mail piece will be insufficient to ensure a reliably readable indicium, then the controller 24 will instruct the tape drive 52 to supply tape to the printer 22, and the printer 22 will be instructed to print the indicium image on the tape instead of on the mail piece. Alternatively, the controller 24 can stop processing of the mail piece and instruct the user, using, for example, the I/O 26, that a tape must be printed, and upon receiving a signal from the user, using, for example, the I/O 26, the image will be printed on the tape. For smaller systems that are not equipped with the tape drive 52, the controller 24 can stop processing and instruct the user to remove the mail piece, insert a tape under the printer 22, and provide a confirmation signal indicating the tape has been inserted. The printer 22 can then print on the tape inserted by the user. The tape preferably has a very high reflectivity, and therefore any images printed on the tape by the printer 22 will have sufficient contrast between the ink and the tape to ensure a reliably readable image. The controller 24 can optionally provide an instruction to the user, using, for example, the I/O 26, to apply the tape to the mail piece. For larger mail processing systems used to process batches of mail pieces, it may not be desirable for the processing of the batch to slow down or halt while the user places the tape on a mail piece. For such large systems, mail pieces that require application of a tape may be out-sorted or specially processed, e.g., the edge of the mail piece may be marked for easier identification in the batch, or the mail piece orientation slightly altered so it will stand out from the other mail pieces in the batch, or the mail piece position in the batch recorded, to allow the user to easily identify and affix the tape to a mail piece after the batch processing has been completed. By printing the indicium image on a highly reflective tape for darker colored mediums, e.g., envelopes or mail pieces, and applying the tape to the mail piece, it ensures that sufficient contrast is always provided between the image, e.g., indicium, and the background to produce a reliably readable image.

Figure 4:
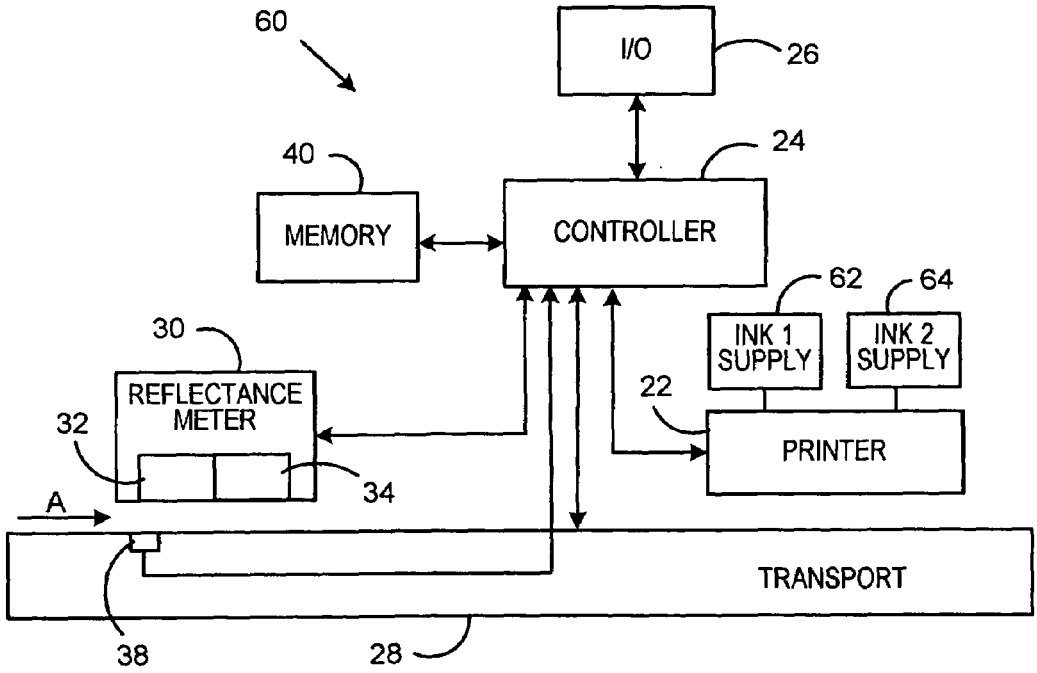
FIG. 4 illustrates in block diagram form a portion of a mail processing system according to another embodiment of the present invention.

Referring now to FIG. 4, there is illustrated in block diagram form a portion of a mail processing system 60 according to another embodiment of the present invention. Mail processing system 60 is similar to mail processing system 20 as described with respect to FIG. 2, except that the mail processing system 60 does not include the label applicator 44 and instead includes multiple ink supplies 62, 64 to supply ink to the printer 22. While only two ink supplies 62, 64 are illustrated in FIG. 4, it should be understood that any number of ink supplies can be provided as desired. Each ink supply 62, 64 contains a different color pigment or dye based ink that can be used, either alone or in combination, to print an image as described below. Preferably, one of the ink supplies 62 contains an ink colored as dark as possible to provide the greatest contrast with respect to a typical mail piece upon which an indicium will be printed, such as, for example, a white or off-white mail piece, while the other ink supply 64 contains a light colored ink that can be used for darker colored mail pieces.

The controller 24 will specify the ink(s) to be used to print an indicium on the mail piece based on the determined reflectivity of the mail piece. If it is determined that the mail piece has high reflectivity, and therefore will have a high contrast with the dark colored ink typically used to print an indicium, the indicium will be printed directly on the mail piece by the printer 22 using the dark colored ink from ink supply 62. If however, it is determined that the mail piece has a low reflectivity, and therefore the contrast between the dark color ink from ink supply 62 and the mail piece will be insufficient to ensure a reliably readable indicium, then the controller 24 will instruct the printer 22 to print the indicium using the lighter colored ink from ink supply 64 to produce, in effect, a reverse image of the indicium. The use of the light colored ink on the darker mail piece will provide sufficient contrast to ensure a reliably readable image. If different shades of light colored ink are available from different ink supplies, the controller 24 can determine which shade will provide the greatest contrast based on the reflectivity of the mail piece and the indicium can be printed using the shade of ink selected by the controller 24.

In some situations, it may be required, for example, by the postal authorities, to print the indicium using a dark colored ink, e.g., black ink. As an alternative to using a light colored ink on darker envelopes, the controller 24 can controller the printer 22 to use both the dark ink and the light ink when printing the indicium. The light ink can be printed as a background, and the indicium printed with the dark ink as a foreground. The use of the light colored ink as a background will provide sufficient contrast with the dark colored ink used to print the image to ensure a reliably readable image.

Figure 5A:
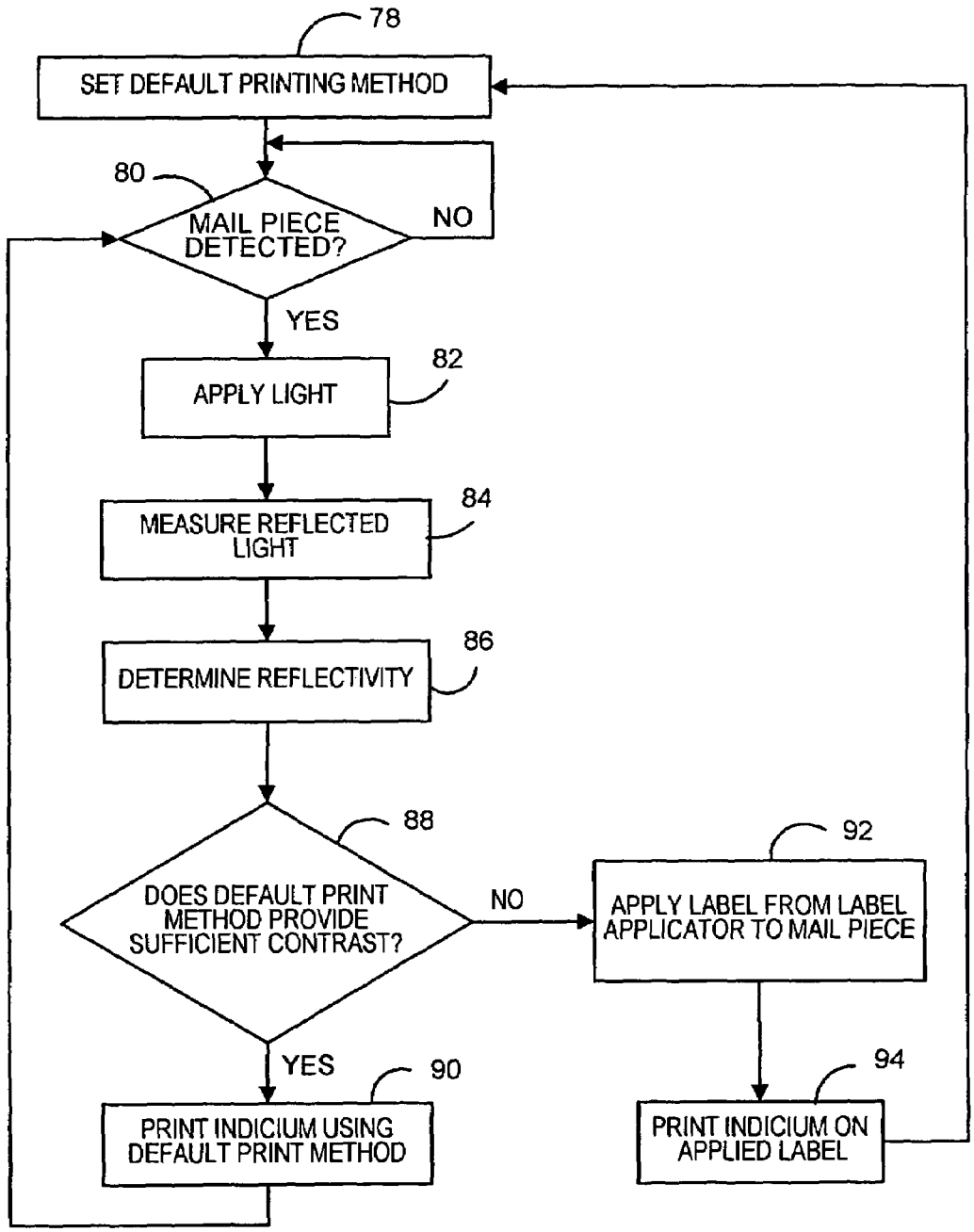
FIGS. 5A–5C illustrate in flow chart form an example of the processing of mail pieces performed by the mail processing systems of FIGS. 2–4.
Figure 5B:
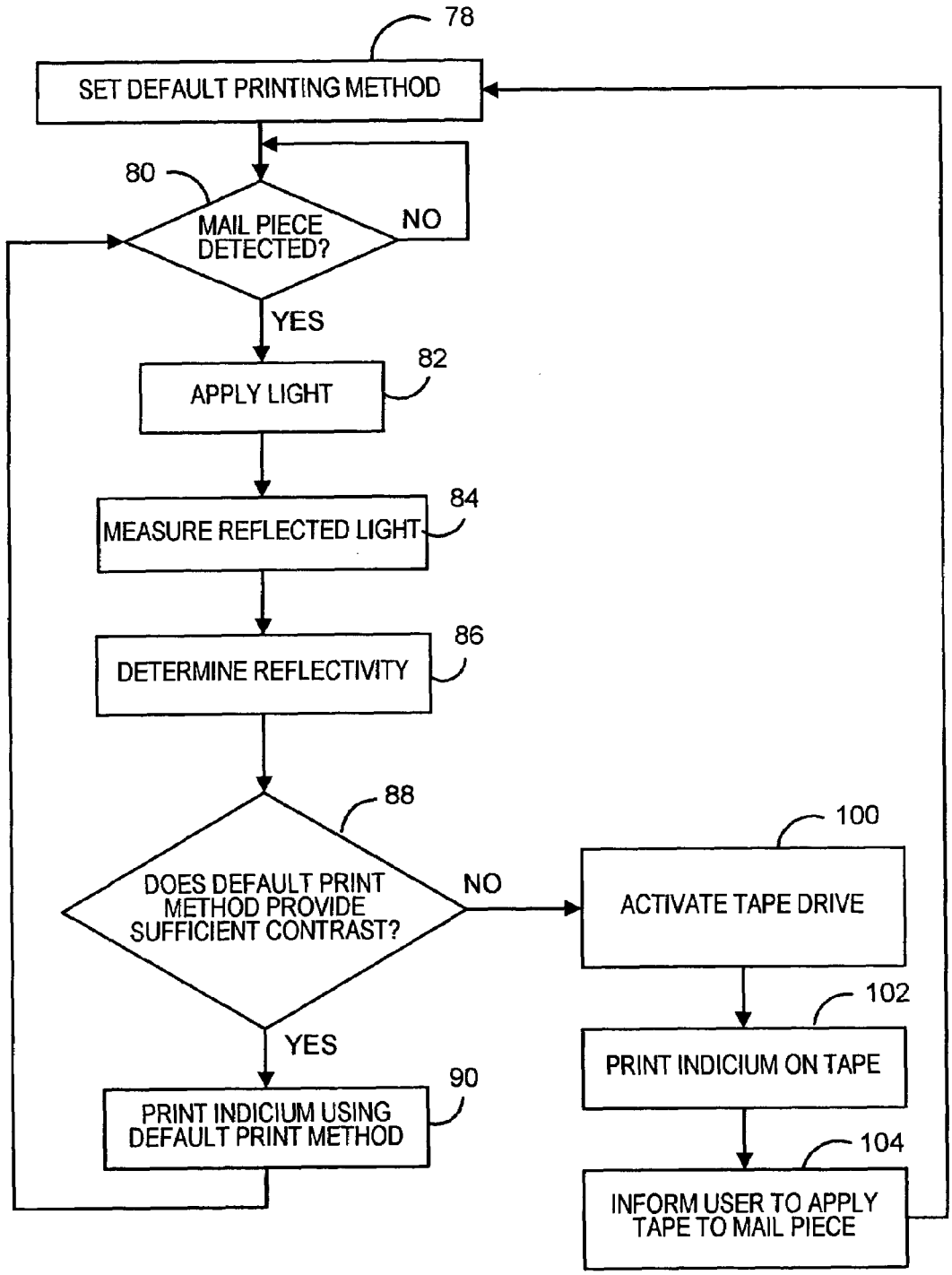
Figure 5C:
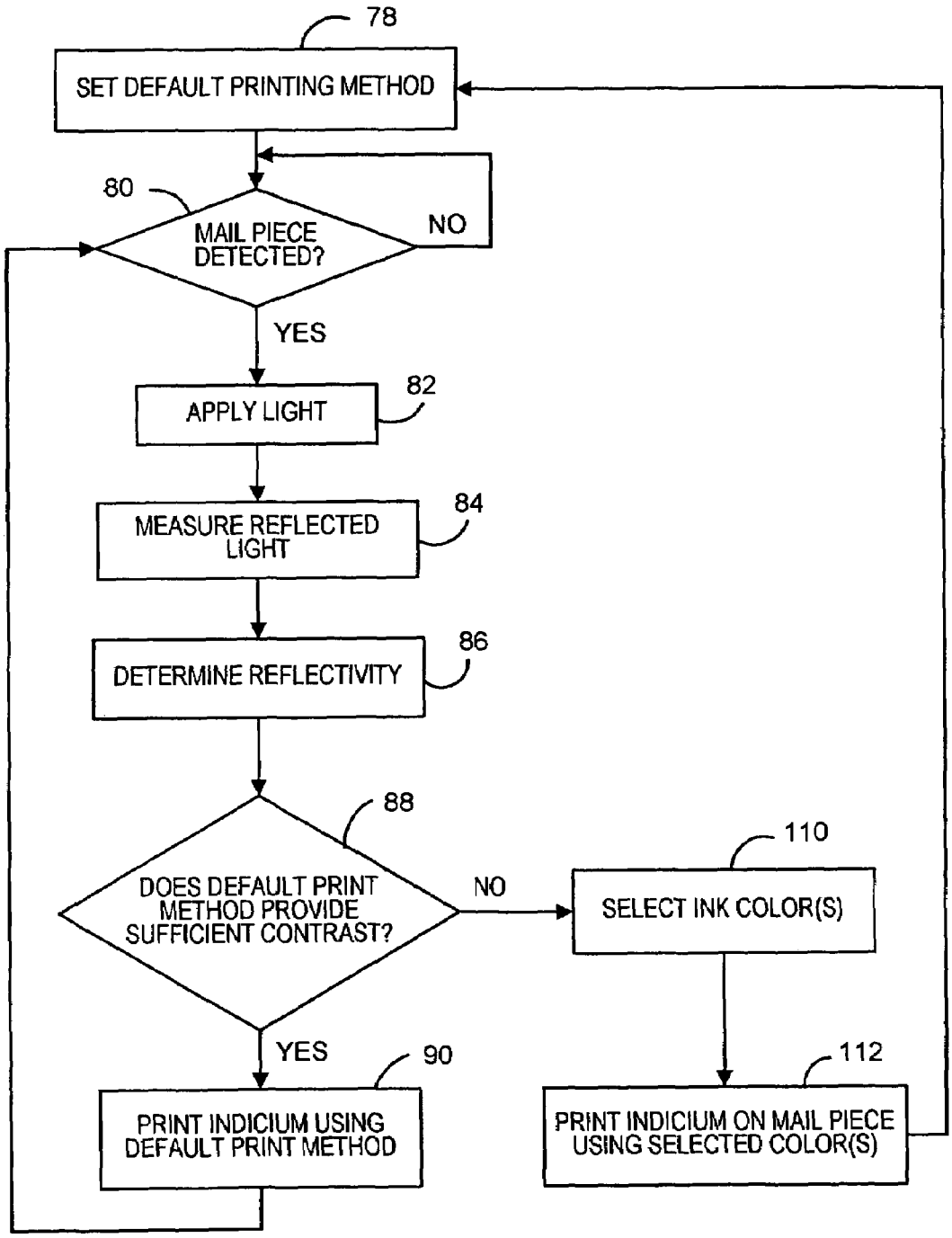

Referring now to FIGS. 5A–5C, there is illustrated in flow chart form an example of the processing of mail pieces performed by the mail processing systems of FIGS. 2–4, respectively. Preferably, the processing as illustrated in FIGS. 5A–5C is performed on each mail piece processed by the mail processing system 20, 50, 60. When mail processing system 20, 50, 60 is turned on, in step 78 a default print method for printer 22 is set, preferably as printing directly on a mail piece using a dark colored ink. As mail pieces are input to the mail processing system 20, 50, 60, the transport 28 will transport the mail pieces through the system 20, 50, 60. In step 80, it is determined if a mail piece is detected beneath the reflectance meter 30 by the sensor 38. Once a mail piece has been detected, then in step 82 the light source 32 is activated to apply light to the mail piece. Optionally, the light source 32 could always be activated instead of being turned on and off. In step 84, the light reflected by the mail piece is measured by the photodetectors 34. In step 86, based on the amount of light reflected, the reflectivity of the mail piece is determined as previously described, and hence the relative lightness or darkness or glossiness of the mail piece. As noted above, the amount of reflected light is less for a darker mail piece than a lighter mail piece, as the darker mail piece will absorb part of the applied light from the light source 32, while a lighter mail piece will have less absorption of the applied light and therefore more reflected light.

In step 88, it is determined if the current printing method will provide sufficient contrast between the image and the mail piece, based on the determined reflectivity of the mail piece, to ensure a reliably readable indicium. Thus, for example, for lighter colored mail pieces that have a higher reflectivity, the default print method of using dark color ink to print directly on the mail piece should provide sufficient contrast. In step 90, the indicium will be printed on the mail piece using the dark colored ink. The processing will then return to detect another mail piece in step 80. If it is determined in step 88 that the current printing method will not provide sufficient contrast to ensure a reliably readable indicium, then for system 20, the controller 24 will activate the label applicator 44 to apply a label to the mail piece in step 92, as illustrated in FIG. 5A, and in step 94 the indicium will be printed on the label applied in step 92 using the dark colored ink. Alternatively, the indicium can be printed on the label and the label then applied to the mail piece. Preferably, the printer 22 will revert back to the default printing method in step 78 after every mail piece, and change to an alternative printing method only when a darker colored or glossy mail piece is being processed. For system 50, if it is determined in step 88 that the current printing method will not provide sufficient contrast to ensure a reliably readable indicium, then in step 100 the controller 24 will activate the tape drive 52 as illustrated in FIG. 5B, or alternatively provide a signal to the user that a tape should be printed. In step 102 the indicium will be printed on the tape from the tape drive 52 or, if no tape drive is provided, the tape inserted by the user, using the dark colored ink. Optionally, in step 104 the user can be informed that the tape needs to be applied to the mail piece. Alternatively, the tape can be applied automatically to the mail piece. Preferably, the printer 22 will revert back to the default printing method in step 78 after every mail piece, and change to an alternative printing method only when a darker colored mail piece is being processed. For system 60, if it is determined in step 88 that the current printing method will not provide sufficient contrast to ensure a reliably readable indicium, then in step 110 the controller 24 will select an appropriate ink color or colors (if background printing is to be used) based at least in part on the determined reflectivity, as illustrated in FIG. 5C, and in step 112 the indicium will be printed on the mail piece using the color(s) selected by the controller 24 in step 110. Preferably, the printer 22 will revert back to the default printing method in step 78 after every mail piece, and change to an alternative printing method only when a darker colored or glossy mail piece is being processed.

It should be noted that while each of FIGS. 2–4 show alternative embodiments of the present invention and FIGS. 5A–5C describe operation of each of the embodiments, a mail processing system can include one or more of the features of each of the embodiments in any combination. Thus, a mail processing system can include both the label applicator 44 and tape drive 52, the label applicator 44 and multiple ink supplies 62, 64, the tape drive 52 and multiple ink supplies 62, 64, or all three of the label applicator 44, tape drive 52 and multiple ink supplies 62, 64. The controller 24 can determine, based on the determined reflectivity of a mail piece, the best method to use for printing the indicium on the mail piece and either activate the label applicator 44, tape drive 52 or cause the printer 22 to use different inks when printing the indicium.

Thus, a printing system is provided that dynamically adjusts the method of printing an image based on the lightness or darkness or glossiness of the medium upon which the image will be printed. The reflectivity of the medium upon which an image is to be printed is determined, and hence the relative lightness or darkness or glossiness of the medium. The way in which the image will be printed is adjusted based on the determined reflectivity of the medium. For lighter colored mediums, on which sufficient contrast between the ink used to print the image and the medium will be provided, the image can be printed directly onto the medium. For highly reflective mediums, it may be desirable to reduce the amount of ink used to print the image, thereby reducing the ink costs. For darker colored or glossy mediums, on which the ink used to print the image will not provide enough contrast with respect to the medium to produce a reliably readable image, the method of printing the image is modified to ensure sufficient contrast to produce a reliable readable image.

While preferred embodiments of the invention have been described and illustrated above, it should be understood that these are exemplary of the invention and are not to be considered as limiting. Those skilled in the art will recognize that various additions, deletions, substitutions, and other modifications can be made without departing from the spirit or scope of the present invention. For example, the print method can be changed only for the barcode portion of the indicium instead of the entire indicium. An imaging device could be located just past the printer 22 and the first portion of the indicium, e.g., the human readable information 14, printed using the default printing method. The contrast provided by the default printing method can be determined based on the first portion of the indicium, and if necessary, the printing method changed for printing the barcode portion of the indicium. The label from label applicator 44 can be applied only over the area where the barcode will be printed, or different inks used to print only the barcode. Accordingly, the invention is not to be considered as limited by the foregoing description of the preferred embodiments but is defined by the appended claims and their equivalents.

What is claimed is:

1. A method for printing an image on a medium comprising:

determining a reflectivity of the medium;

determining, based on the determined reflectivity of the medium, if printing the image directly on the medium will provide sufficient contrast between the image and the medium for reading the image;

if printing the image directly on the medium will provide sufficient contrast between the image and the medium for reading the image, printing the image directly on the medium;

if printing the image directly on the medium will not provide sufficient contrast between the image and the medium for reading the image, applying a label to the medium in a location where the image is to be printed, the label having a reflectivity that will provide sufficient contrast between the image and the label; and printing the image on the label.

2. The method of claim 1, wherein the image is printed on the label before the label is applied to the medium.

3. The method of claim 1, wherein the medium is a mail piece.

4. The method of claim 3, wherein the image includes at least a portion of an indicium evidencing payment of postage for the mail piece.

5. A printing system for printing an image on a medium comprising:

a controller to control operation of the system;

a reflectance meter coupled to the controller to determine a reflectivity of the medium upon which the image will be printed;

a printer coupled to the controller to print the image on the medium; and a label applicator coupled to the controller, the label applicator to apply a label to the medium, wherein the controller, based on the determined reflectivity of the medium, will cause the printer to print the image directly on the medium if sufficient contrast will be provided between the image and the medium for reading the image, and if printing the image directly on the medium will not provide sufficient contrast between the image and the medium for reading the image, the controller will cause the label applicator to apply a label to the medium in a location where the image is to be printed on the medium and the image will be printed on the label applied to the medium.

6. The system of claim 5, wherein the medium is a mail piece.

7. The system of claim 6, wherein the image includes at least a portion of an indicium evidencing payment of postage for the mail piece.

8. The system of claim 5, further comprising:

a transport to transport the medium along a transport path through the system, wherein the label applicator is located upstream from the printer along the path of travel.

9. The system of claim 5, wherein the medium is stationary and the printer moves with respect to the medium to print on the medium, and the label applicator is attached to the printer to move along with the printer.

* * * * *